US006309563B1

(12) United States Patent
Iino et al.

(10) Patent No.: US 6,309,563 B1
(45) Date of Patent: Oct. 30, 2001

(54) CONDUCTIVE SILICONE RUBBER COMPOSITION AND LOW-RESISTANCE CONNECTOR

(75) Inventors: Mikio Iino; Tsutomu Nakamura, both of Usui-gun; Kazuhiko Aoki, Matsumoto, all of (JP)

(73) Assignees: Shin-Etsu Chemical Co., Ltd.; Shin-Etsu Polymer Co., Ltd., both of Tokyo (JP)

( * ) Notice: Subject to any disclaimer, the term of this patent is extended or adjusted under 35 U.S.C. 154(b) by 0 days.

(21) Appl. No.: 09/534,495

(22) Filed: Mar. 24, 2000

(30) Foreign Application Priority Data

Mar. 25, 1999 (JP) ..... 11-081928
Apr. 13, 1999 (JP) ..... 11-105095

(51) Int. Cl.[7] ..... H01B 1/22; H01R 4/58
(52) U.S. Cl. ..... 252/514; 428/447; 439/86
(58) Field of Search ..... 252/514; 528/10; 524/912; 428/447, 922; 439/86

(56) References Cited

U.S. PATENT DOCUMENTS 5,075,038 * 12/1991 Cole et al. ..... 252/514
5,173,765 * 12/1992 Nakayoshi et al. ..... 257/783
5,807,507 9/1998 Hirano et al. .
5,928,569 * 7/1999 Reo ..... 252/514

FOREIGN PATENT DOCUMENTS 197 36 668 3/1998 (DE) .
0 430 255 6/1991 (EP) .

OTHER PUBLICATIONS

Derwent English abstract of JP62141045 (Jun. 24, 1987).

Patent Abstracts of Japan 04149906 (May 22, 1992).

Patent Abstracts of Japan 63117065 (May 21, 1988).

* cited by examiner

*Primary Examiner*—Mark Kopec
(74) *Attorney, Agent, or Firm*—Millen, White, Zelano & Branigan, P.C.

(57) ABSTRACT

A conductive silicone rubber composition comprising (A) an organopolysiloxane having at least two aliphatic unsaturated groups, (B) a conductive powder comprising a silver powder premixed with 0.2–5% by weight of fine powder selected from the group consisting of inorganic fillers and spherical organic resins, and (C) a curing agent has a stable volume resistivity.

18 Claims, No Drawings

CONDUCTIVE SILICONE RUBBER COMPOSITION AND LOW-RESISTANCE CONNECTOR

This invention relates to electrically conductive silicone rubber compositions, and more particularly, to conductive silicone rubber compositions which cure into silicone rubber with a stable resistance. It also relates to low-resistance connectors suitable for connection between liquid crystal displays and circuit boards or between electronic circuit boards.

BACKGROUND OF THE INVENTION

Owing to its high electrical conductivity, silver powder is widely utilized as a conductive filler in a variety of silicone rubber compositions including addition reaction curing type silicone rubber compositions, condensation reaction curing type silicone rubber compositions, and peroxide vulcanizing type silicone rubber compositions. Since silicone rubber compositions having silver powder blended therein cure into silicone rubber with a low electrical resistance, they are used in the application where electrical conductivity and heat resistance are required. The silver powder blended in silicone rubber compositions usually takes the form of particles and flakes.

As a general rule, silver powder has a strong tendency to agglomerate. The silver powder which is stored for a long term is unsuitable to add to silicone rubber compositions because it is difficult to disperse the agglomerated silver powder during compounding. An improvement in this regard is desired. Another problem is that the cured silicone rubber has a volume resistivity which is unstable.

In particular) flake silver powder is utilized in forming low-resistance (or high conductivity) silicone rubber. In order to facilitate compounding, silver powder is often treated with a chemical agent during commutation. Such chemical agents are saturated or unsaturated higher fatty acids such as lauric acid, myristic acid, palmitic acid, stearic acid, and oleic acid, metal soaps, higher aliphatic amines and polyethylene wax. This treatment, however, has a possibility to retard vulcanization of silicone rubber compositions to which treated silver powder has been added.

It has recently been considered to use silver powder-loaded connectors instead of U-shaped metal wire connectors for providing connection between electronic circuit boards. The silver powder-loaded connectors include a plurality of layers of a conductive elastomer and an insulating elastomer which are stacked in a zebra pattern, and provide a stable contact, avoiding a point contact and display failure.

However, silver powder used as the conductive element tends to agglomerate and becomes difficult to added to elastomers after a long-term storage as mentioned above. If agglomerated silver powder is compounded, dispersion becomes poor, resulting in a resistance instability and variation.

When elastomers are stacked in alternating layers to construct a zebra connector, the poorly dispersed silver powder can cause a puncture phenomenon that upon pressing in a block form for vulcanization, tearing occurs within conductive layers or at the interface between a conductive layer and an insulating layer. It is then very difficult to consistently manufacture such connectors on a mass scale.

SUMMARY OF THE INVENTION

A first object of the invention is to provide a conductive silicone rubber composition containing silver powder which is prevented from agglomeration and thus highly compatible with the remaining components, the composition curing into a silicone rubber having a stable volume resistivity.

A second object of the invention is to provide a low-resistance connector which establishes a stable conductive path when used between a liquid crystal display and a circuit board or between circuit boards and which can be mass produced at a low cost.

We have found that by admixing silver powder with at least 0.2% by weight of fine powder selected from the group consisting of inorganic fillers and spherical organic resins, there is obtained a conductive powder which is effectively dispersible. This conductive powder eliminates the above-mentioned problems of silver powder by itself.

More particularly, when silver powder is admixed with at least 0.2% by weight of fine powder selected from the group consisting of inorganic fillers and spherical organic resins, the resulting conductive powder (silver powder) does agglomerate little with the lapse of time and is effectively dispersible in silicone rubber compounds. By blending an organopolysiloxane having at least two aliphatic unsaturated groups with an appropriate amount of the conductive powder, there is obtained a silicone rubber composition which has a stabilized volume resistivity. This composition can be cured with an organic peroxide or an organohydrogen-polysiloxane/platinum base catalyst alone or with a combination of an organic peroxide with an organohydrogen-polysiloxane/platinum base catalyst. The composition is molded and cured into a silicone rubber product which has a stable low resistance (or stable high conductivity) and performs well during long-term service and is thus suited as conductive contact members, connectors, roll members in business machines, and electromagnetic shield gaskets.

In a first aspect, the invention provides a conductive silicone rubber composition comprising (A) 100 parts by weight of an organopolysiloxane having at least two aliphatic unsaturated groups, represented by the following average compositional formula (1):

$$R^1_nSiO_{(4-n)/2} \quad (1)$$

wherein $R^1$ is independently a substituted or unsubstituted monovalent hydrocarbon group and n is a positive number of 1.98 to 2.02, (B) 100 to 800 parts by weight of a conductive powder comprising a silver powder premixed with at least 0.2% by weight of fine powder selected from the group consisting of inorganic fillers and spherical organic resins, and (C) a sufficient amount to cure component (A) of a curing agent.

In a second aspect, the invention provides a low-resistance connector comprising a plurality of alternating layers of a conductive elastomer and an insulating elastomer, at least one elastomer being flexible, which are alternately disposed to form a multilayer structure such that their juncture surfaces are parallel to each other, each conductive elastomer layer comprising as a conductive element a cured product of a silicone rubber composition according to the first aspect.

Since the conductive powder which can be stored for a long term and effectively dispersed in silicone rubber compounds is used as a steady-resistivity conductive element, the connector can be mass produced at a low cost. The low-resistance connector offers a stable conductive path when used between a liquid crystal display of the COG or TAB type and a circuit board or between circuit boards.

DESCRIPTION OF THE PREFERRED EMBODIMENTS

The silicone rubber composition according to the invention includes as a first essential component (A) an organopolysiloxane represented by the following average compositional formula (1):

$$R^1_nSiO_{(4-n)/2} \quad (1)$$

wherein $R^1$ is independently a substituted or unsubstituted monovalent hydrocarbon group and n is a positive number of 1.98 to 2.02, The substituted or unsubstituted monovalent hydrocarbon groups represented by $R^1$, which may be identical or different, are preferably those of 1 to 10 carbon atoms, more preferably 1 to 8 carbon atoms. Examples include alkyl groups such as methyl, ethyl, propyl, butyl, hexyl, and octyl; cycloalkyl groups such as cyclohexyl; alkenyl groups such as vinyl, allyl, propenyl, butenyl, and hexenyl; aryl groups such as phenyl and tolyl; aralkyl groups such as benzyl and phenylethyl; and substituted ones of the foregoing groups in which some or all of the hydrogen atoms attached to carbon atoms are replaced by halogen atoms or cyano groups, such as chloromethyl, trifluoropropyl, and cyanoethyl. At least two of the $R^1$ groups must be aliphatic unsaturated groups (i.e., alkenyl groups). The content of aliphatic unsaturated groups is preferably 0.001 to 20 mol %, more preferably 0.025 to 5 mol % of the $R^1$ groups. The letter n is a positive number of 1.98 to 2.02. Preferably, the organopolysiloxane of formula (1) basically has a linear structure, although a mixture of two or more organopolysiloxanes of different structures is acceptable.

The organopolysiloxane should preferably have an average degree of polymerization of 100 to 10,000.

Component (B) is a conductive powder based on silver powder. The silver powder used herein is not critical. Included are silver powders in particulate, dendrite and flake forms which are prepared, for example, by electrolytic, comminution, heat treatment, atomizing and chemical methods. Also included are glass beads and phenolic resin beads plated with silver.

The particle size of silver particles is not critical although a mean particle size in the range of 0.05 to 100 $\mu$m and especially 0.1 to 10 $\mu$m is preferred.

Also the shape of silver particles is not critical. Included are silver particles of particulate, dendrite, flake and irregular shapes and mixtures thereof. For the purpose of forming low-resistance silicone rubber, a silver powder of partially attached particles is advantageous rather than a silver powder of completely discrete particles.

Any desired device may be used for comminuting silver powder. Well-known comminuting devices, for example, stamp mills, ball mills, vibrating mills, hammer mills, roll mills and mortars are useful. Silver powder in the form of reduced silver, atomized silver, electrolytic silver and a mixture of two or more of these can be roll milled under appropriate conditions which may be selected depending on the desired particle size and shape of the silver powder.

Silver-plated glass beads and phenolic resin beads are also useful as the silver powder.

In combination with the silver powder, there may be used another conductive agent in the form of a conductive inorganic material such as conductive carbon black, conductive zinc white or conductive titanium oxide and an extending filler such as silicone rubber powder, red iron oxide, ground quartz or calcium carbonate.

When held in air, silver particles are likely to form an oxide or sulfide which is an insulating material. Then, when a connector containing silver powder is held for some time in air after its manufacture, the connector can increase its resistivity due to oxidation or sulfiding.

The flake silver powder utilized in forming low-resistance silicone rubber is often treated with a saturated or unsaturated higher fatty acid such as lauric acid, myristic acid, palmitic acid, stearic acid or oleic acid, metal soap, higher aliphatic amine or polyethylene wax during comminution. These chemical agents used in the treatment, however, have a possibility to retard vulcanization of silicone rubber compositions to which treated silver powder has been added.

These problems are solved by the following approach. The treated silver powder is washed to remove the chemical agent before it is blended in a conductive elastomer, from which a low-resistance connector is constructed. A solution of a mercapto compound in a solvent or water is applied to the contact portions of the connector to form a protective coating which is effective for preventing oxidation and sulfiding of silver particles. The connector then has a stabilized resistivity.

According to the invention, fine powders selected from the group consisting of inorganic fillers and spherical organic resins are premixed with the silver powder for preventing the silver particles from agglomerating.

Examples of the inorganic fillers include silica, alumina, titanium dioxide, mica, barium sulfate, and carbon black. Among them, silica, alumina and carbon black are preferred. Especially, silica fine powder is desirably used. Examples of the spherical organic resins include polyolefins such as polyethylenes, polyvinyl chlorides, polypropylenes and polystyrenes, styrene-acrilonitrile copolymers, acrylic resins such as polymethylmethacrylate, amino resins, fluorinated resins, and nitrile resins. Among them, methylmethacrylate is especially preferred. The above inorganic fillers and spherical organic resins are used singly or in combination.

The mean particle size of the inorganic fillers and the spherical organic resins is preferably 0.005 to 50 $\mu$m, more preferably 0.01 to 30 $\mu$m.

Among the inorganic fillers, silica fine powder is preferred as described above. The silica fine powder used herein preferably has a specific surface area of at least 50 $m^2/g$, and especially 100 to 300 $m^2/g$, as measured by the BET method. Silica fine powder having a specific surface area of less than 50 $m^2/g$ may be less effective for preventing agglomeration. The silica fine powder includes, for example, fumed silica and precipitated silica. Such silicas which are surface treated with chlorosilanes, hexamethyldisilazane, organopolysiloxanes or alkoxysilanes for hydrophobicization are also useful.

At least 0.2% by weight, especially 0.5 to 5% by weight of the inorganic filler and/or spherical organic resin fine powder is admixed with 100 parts by weight of the silver powder. It is recommended to mix it for about 5 minutes to about 5 hours in a tumbling mixer, etc. If the amount of the fine powder added is less than 0.2% by weight, the agglomeration preventing effect declines. More than 5% by weight of the fine powder may sometimes increase an electrical resistance.

Premixing the fine powder with the silver powder is essential for the invention. When separate silver powder and the fine powder are blended with the organopolysiloxane during preparation of the composition rather than using a conductive powder of silver powder premixed with the fine powder, the benefits of the invention are not obtained.

The conductive powder is blended in an amount of 100 to 800 parts, especially 200 to 600 parts by weight per 100 parts by weight of the organopolysiloxane (A). Less amounts of the conductive powder may fail to impart satisfactory conductivity. Excessive amounts of the conductive powder may restrain compounding and working into a thin film as the conductive elastomer layer.

Component (C) is a curing agent which may be selected from well-known ones, for example, organohydrogenpolysiloxane/platinum base catalysts (curing agents for addition reaction) and organic peroxide catalysts.

Well-known platinum base catalysts for promoting addition reaction are useful. Exemplary catalysts are elemental platinum alone, platinum compounds, platinum complexes, chloroplatinic acid, complexes of chloroplatinic acid with alcohol compounds, aldehyde compounds, ether compounds, and olefins. The platinum base catalyst is added in a catalytic amount, desirably about 1 to about 2,000 ppm of platinum atom based on the weight of the organopolysiloxane (A).

Any desired organohydrogenpolysiloxane containing at least two hydrogen atoms each attached to a silicon atom (i.e., at least two SiH groups) in a molecule is useful. It may be of straight, branched or cyclic molecule. Preferably, it has the formula: $R^2_aH_bSiO_{(4-a-b)/2}$ wherein $R^2$ is a substituted or unsubstituted monovalent hydrocarbon group as defined for $R^1$, preferably free of an aliphatic unsaturated bond, and letters a and b are numbers satisfying $0 \leqq a<3$, $0<b<3$, and $0<a+b<3$. A degree of polymerization of up to 300 is preferable. Illustrative examples include diorganopolysiloxanes end-blocked with a dimethylhydrogensilyl group, copolymers consisting of dimethylsiloxane units, methylhydrogensiloxane units and terminal trimethylsiloxy units, low-viscosity fluids consisting of dimethylhydrogensiloxane units ($H(CH_3)_2SiO_{1/2}$ units) and $SiO_2$ units, 1,3,5,7-tetrahydrogen-1,3,5,7-tetramethylcyclotetrasiloxane, 1-propyl-3,5,7-trihydrogen-1,3,5,7-tetramethylcyclotetrasiloxane, and 1,5-dihydrogen-3,7-dihexyl-1,3,5,7-tetramethylcyclotetrasiloxane.

The organohydrogenpolysiloxane is added as the curing agent in such amounts that 50 to 500 molt of silicon-attached hydrogen atoms are available based on the aliphatic unsaturated groups (alkenyl groups) in the organopoly-siloxane (A).

The organic peroxide catalyst may be selected from well-known ones, for example, benzoyl peroxide, 2,4-dichlorobenzoyl peroxide, p-methylbenzoyl peroxide, 2,4-dicumyl peroxide, 2,5-dimethyl-bis(2,5-t-butylperoxy) hexane, di-t-butyl peroxide, and t-butyl perbenzoate. The organic peroxide may be added in an amount of 0.1 to 5 parts by weight per 100 parts by weight of the organopolysiloxane (A).

If the amount of the organohydrogenpolysiloxane and platinum base catalyst or the organic peroxide catalyst used as the curing agent (C) is less than the above-specified range, then a longer time may be taken for vulcanization and curing, which is inadequate for mass production. Beyond the range, the time for vulcanization and curing may become so short that when conductive elastomer layers and insulating elastomer layers are alternately laid and bonded by vulcanization, the conductive elastomer layers can start curing before bonding, resulting in an insufficient bond and increasing a possibility of delamination.

In the silicone rubber composition of the invention, reinforcing silica powder may be added as an optional component insofar as the benefits of the invention are not impaired. The reinforcing silica powder is added for the purpose of improving the mechanical strength of silicone rubber. To this end, the reinforcing silica powder should preferably have a specific surface area of at least 50 $m^2/g$, especially 100 to 300 $m^2/g$. With a specific surface area of less than 50 $m^2/g$, the cured product would be rather reduced in mechanical strength. Examples of the reinforcing silica powder include fumed silica and precipitated silica, which may be surface treated with chlorosilanes or hexamethyldisilazane for hydrophobicization. The amount of reinforcing silica powder added is preferably 3 to 70 parts, especially 10 to 50 parts by weight per 100 parts by weight of the organopolysiloxane (A). Less than 3 parts of silica powder would be ineffective for reinforcement whereas more than 70 parts of silica powder would lead to poor workability and lower mechanical strength.

Where it is desired to form a sponge rubber, any of inorganic and organic blowing agents may be added. Exemplary blowing agents include azobisisobutyronitrile, dinitropentamethylene tetramine, and benzenesulfonhydrazide azodicarbonamide. An appropriate amount of the blowing agent is 1 to 10 parts by weight per 100 parts by weight of the organopolysiloxane (A). By adding a blowing agent to the inventive composition, a sponge silicone rubber is produced.

Moreover, various additives such as colorants, heat resistance modifiers, reaction control agents, parting agents, and filler dispersants may be added to the inventive compositions. The dispersants for fillers include diphenylsilane diol, alkoxysilanes, carbon functional silanes, and silanol group-bearing low molecular weight siloxanes. Such dispersants are added in minimal amounts so that the benefits of the invention may not be lost.

Where it is desired to make the silicone rubber composition flame retardant and fire resistant, well-known additives may be added. Examples include platinum-containing substances, a mixture of a platinum compound and titanium dioxide, a mixture of platinum and manganese carbonate, a mixture of platinum and $\gamma$-$Fe_2O_3$, ferrite, mica, glass fibers, and glass flakes.

The silicone rubber composition of the invention can be prepared by uniformly mixing the above-described components in a rubber mill such as a twin-roll mil, Banbury mixer or dough mixer (kneader), optionally followed by heat treatment.

The silicone rubber composition thus obtained may be molded to a shape for a particular application by various molding methods, for example, compression molding, extrusion molding and calender molding methods. Curing conditions are properly selected depending on the curing method and the thickness of a molded part although the preferred set of conditions includes a temperature of about 80 to 400° C. and a time of about 10 seconds to 30 days.

The cured product of the silicone rubber composition has a volume resistivity of up to 0.1 Ω-cm, and especially up to $1.1\times10^{-3}$ Ω-cm, which indicates that the cured product can be used as connectors and electromagnetic shields.

The low-resistance connector according to the second aspect of the invention is defined as comprising a plurality of alternating layers of a conductive elastomer and an insulating elastomer. At least one of the elastomers is flexible. The conductive and insulating elastomer layers are alternately disposed to form a multilayer structure such that their juncture surfaces are parallel to each other. The conductive element of each conductive elastomer layer is a cured product of a silicone rubber composition comprising components (A), (B) and (C) as defined above.

The elastomer used in the insulating elastomer layers may be any of elastic materials which are stable in shape and do not undergo noticeable deformation under gravity or plastic deformation after curing. Examples include natural rubber; rubbery copolymers such as butadiene-styrene, acrylonitrile-butadiene, acrylonitrile-butadiene-styrene, styrene-ethylene, ethylene-propylene, and ethylene-propylene-diene copolymers; synthetic rubbers such as chloroprene rubber, silicone rubber, butadiene rubber, isoprene rubber, chlorosulfonated polyethylene rubber, polysulfide rubber, butyl rubber, fluoro-rubber, urethane rubber, and polyisobutylene rubber; thermoplastic elastomers such as polyester elastomers; plasticized vinyl chloride resins, vinyl acetate resins, and vinyl chloride-vinyl acetate copolymer resins. Of these, silicone rubber is preferred because of its advantages including aging properties, electrical insulation, heat resistance, compression set, ease of processing and a low fixed cost.

The silicone rubbers used the insulating elastomer layers are polysiloxanes such as dimethyl-, methylphenyl- and methylvinylsiloxanes, halogenated polysiloxanes which are loaded with a filler such as silica to impart suitable rheological properties, and halogenated polysiloxanes which are vulcanized or cured with metal salts.

The low-resistance connector is prepared by alternately disposing low-resistance conductive elastomer layers (formed using the above-described conductive element) and insulating elastomer layers and curing the stack. The connector as cured preferably has a hardness of 50 to 80° H, and especially 60 to 80° H. Then, the connector achieves uniform connection between electronic circuit boards even under a compression rate as small as 2 to 10%. This substantially avoids buckling by compression. A stable contact is ensured while the load to the device is minimized. It becomes possible to reduce the size and weight of IC inspection instruments.

The conductive elastomer layers and the insulating elastomer layers from which the low-resistance connector is constructed are prepared by a printing or calendering method. Layer stacking by calendering is preferable because of stable productivity. For example, an insulating elastomer layer is formed on a polyethylene terephthalate film by calendering to a thin film. After heat curing, a conductive elastomer layer is formed on the insulating elastomer layer by calendering to a thin film. The thus laminated thin films were peeled from the PET film. A number of such laminates are successively laid in the same order to construct a laminated block, which is then sliced and cut into connectors. The method of preparing the low-resistance connector is not limited to the above, and the connector can be prepared by various other methods.

It is noted that the hardness referred to herein is measured by the test prescribed in JIS K-6253 (ISO 7619).

EXAMPLE

Examples of the invention are given below by way of illustration and not by way of limitation. All parts are by weight.

Examples 1–5 and Comparative Examples 1–2

Conductive powders (silica-laden silver powders) (A) to (C) were prepared by adding 0.5%, 1.0% and 3.0% by weight of hydrophobic silica fines (commercially available as R-972 from Nippon Aerosil K.K., specific surface area 130 $m^2/g$) to silver powder having a mean particle size of 1.5 to 1.7 $\mu$m, and agitating and mixing them for 30 minutes in a tumbling mixer.

The silver powder to which no silica was added was a control (D). A comparative conductive powder (E) was obtained by adding 0.1% by weight of R-972 to silver powder.

The conductive powders (A) to (E) were allowed to stand at room temperature for 30 days. They were passed through a 150-mesh screen.

TABLE 1

| Conductive powder | A | B | C | D | E |
|---|---|---|---|---|---|
| Silver powder (g) | 99.5 | 99.0 | 97.0 | 100.0 | 99.9 |
| R-972 (g) | 0.5 | 1.0 | 3.0 | 0 | 0.1 |
| 150-mesh screen | entire pass | entire pass | entire pass | 80% pass | 90% pass |

Each conductive powder was added to methylvinylpolysiloxane (siloxane polymer) consisting of 99.85 mol % of dimethylsiloxane units and 0.15 mol % of methylvinylsiloxane units and having an average degree of polymerization of about 8,000 in amounts as shown in Table 2. To 100 parts of the resulting compound was added 0.5 part of dicumyl peroxide. The compound was heat molded under pressure at 1700° C. for 10 minutes, obtaining a sheet of 1 mm thick. The sheet was examined for electrical properties and inspected for foreign matter or agglomerates. The results are shown in Table 2.

TABLE 2

| | | E1 | E2 | E3 | E4 | E5 | CE1 | CE2 |
|---|---|---|---|---|---|---|---|---|
| Components (parts by weight) | Siloxane polymer | 100 | 100 | 100 | 100 | 100 | 100 | 100 |
| | Conductive powder A | 400 | 500 | 600 | — | — | — | — |
| | Conductive powder B | — | — | — | 400 | — | — | — |
| | Conductive powder C | — | — | — | — | 400 | — | — |
| | Conductive powder D | — | — | — | — | — | 400 | — |
| | Conductive powder E | — | — | — | — | — | — | 400 |
| Volume resistivity (Ω-cm) | | $7 \times 10^{-4}$ | $5 \times 10^{-4}$ | $1 \times 10^{-4}$ | $8 \times 10^{-4}$ | $9 \times 10^{-4}$ | $7 \times 10^{-4}$ | $7 \times 10^{-4}$ |
| Foreign matter in sheet | | NO | NO | NO | NO | NO | Found | Found |

Examples 6–10 and Comparative Example 3

Conductive powders (silica-laden silver powders) were obtained as in Example 1 except that fumed silica having a specific surface area of 200 $m^2/g$ (Aerosil 200 by Nippon Aerosil K.K.) or wet silica having a specific surface area of 180 $m^2/g$ (Nipsil LP by Nippon Silica K.K.) was used instead of the hydrophobic silica R-972.

The conductive powders (F to J) were allowed to stand at room temperature for 30 days, then passed through a 150-mesh screen.

TABLE 3

| Conductive powder | F | G | H | I | J |
|---|---|---|---|---|---|
| Silver powder (g) | 99.5 | 99.0 | 97.0 | 90 | 95 |
| Aerosil 200 (g) | 0.5 | 1.0 | 3.0 | 10 | 0 |
| Nipsil LP (g) | 0 | 0 | 0 | 0 | 5 |
| 150-mesh screen | entire pass | entire pass | entire pass | entire pass | entire pass |

As in Example 1, each conductive powder was added to the siloxane polymer which was molded into a sheet, which was examined for volume resistivity and inspected for foreign matter. The results are shown in Table 4.

TABLE 4

| | | E6 | E7 | E8 | E9 | E10 |
|---|---|---|---|---|---|---|
| Components (parts by weight) | Siloxane polymer | 100 | 100 | 100 | 100 | 100 |
| | Conductive powder F | 450 | — | — | — | — |
| | Conductive powder G | — | 450 | — | — | — |
| | Conductive powder H | — | — | 450 | — | — |
| | Conductive powder I | — | — | — | 450 | — |
| | Conductive powder J | — | — | — | — | 450 |
| | Dicumyl peroxide | 0.5 | 0.5 | — | — | 0.5 |
| | C-19A | — | — | 1.0 | 1.0 | — |
| | C-19B | — | — | 2.5 | 2.5 | — |
| Volume resistivity (Ω-cm) | | $6 \times 10^{-4}$ | $6 \times 10^{-4}$ | $7 \times 10^{-4}$ | $8 \times 10^{-2}$ | $1 \times 10^{-3}$ |
| Foreign matter in sheet | | NO | NO | NO | NO | NO |

Note: The amounts of dicumyl peroxide, C-19A and C-19B are per 100 parts of the siloxane polymer and conductive powder combined.
C-19A: addition catalyst (platinum base catalyst) by Shin-Etsu Chemical Co., Ltd.
C-19B: addition crosslinking catalyst (methylhydrogen-polysiloxane) by Shin-Etsu Chemical Co., Ltd.

For comparison purposes, a conductive silicone rubber composition (Comparative Example 3) was prepared by mixing 100 parts of the siloxane polymer with 450 parts of conductive powder D, 3 parts of Aerosil 200, and 0.5 part of dicumyl peroxide. This composition was similarly processed and examined. The sheet had a volume resistivity of $7\times10^{-4}$ Ω-cm and contained foreign matter.

According to the invention, the premixing of silica fines prevents silver powder from agglomerating with the lapse of time and helps the silver powder maintain an affinity to silicone rubber compounds. A silicone rubber composition loaded with the silica-laden silver powder cures into a silicone rubber having a consistent volume resistivity.

Examples 11–12

Conductive powder (K) was obtained by adding 1.0% by weight of aluminum oxide (commercially available as oxide C from Nippon Aerosil K.K., mean particle size of primary particle:20 μm) to silver powder having a mean particle size of 1.5 to 1.7 μm used as in Example 1, and agitating and mixing them for 30 minutes in a tumbling mixer.

Conductive powder (L) was also obtained in the same procedure as above except that spherical polymethylmethacrylate having a mean particle size of 1 gm was used instead of aluminum oxide.

The conductive powders (K) and (L) were allowed to stand at room temperature for 30 days. They were entirely passed through a 150-mesh screen.

As in Example 1, each conductive powder was added to he siloxane polymer which was molded into a sheet, which as examined for volume resistivity and inspected for foreign matter.

The results are shown in Table 5.

TABLE 5

| | | E11 | E12 |
|---|---|---|---|
| Component (parts by weight) | Siloxane polymer | 100 | 100 |
| | Conductive powder K | 400 | — |
| | Conductive powder L | — | 400 |
| Volume resistivity (Ω-cm) | | $7 \times 10^{-4}$ | $8 \times 10^{-4}$ |
| Foreign matter in sheet | | NO | NO |

Examples 13–17 and Comparative Examples 4–5

On a polyethylene terephthalate film of 0.5 mm thick as a base film, an insulating silicone rubber compound (trade name KE971U, Shin-Etsu Chemical Co., Ltd., curing agent C-19A/B) was calender-sheeted to a thickness of 0.03 mm. By curing the compound in a heating oven at 200° C., an insulating elastomer layer was formed.

Separately, a conductive powder was prepared by adding 0.5%, 1.0% or 3.0% by weight of hydrophobic silica fines (commercially available as R-972 from Nippon Aerosil K.K., specific surface area 130 $m^2/g$) to silver powder having a mean particle size of 1.5 to 1.7 μn, and agitating and mixing them for 30 minutes in a tumbling mixer. The silver powder to which no silica was added was a control (d). A comparative conductive powder (e) was obtained by adding 0.1% by weight of R-972 to silver powder.

TABLE 6

| Conductive powder | a | b | c | d | e |
|---|---|---|---|---|---|
| Silver powder (g) | 99.5 | 99.0 | 97 | 100 | 99.9 |
| R-972 (g) | 0.5 | 1.0 | 3.0 | 0 | 0.1 |

Each conductive powder was added to methylvinylpolysiloxane consisting of 99.85 mol % of dimethylsiloxane units and 0.15 mol % of methylvinylsiloxane units and having an average degree of polymerization of about 8,000 in amounts as shown in Table 7. Dicumyl peroxide, 0.5 part, was added to 100 parts of the resulting compound, which was milled, yielding a conductive elastomer compound.

The conductive elastomer compound was calender-sheeted onto the insulating elastomer layer to form a conductive layer of 0.03 mm thick, which was cured. The laminate of insulating and conductive layers was peeled from the base film. A number of such laminates were stacked in the same order to form a laminate block, which was vulcanized and sliced. Secondary vulcanization achieved a hardness of 60° H (JIS K-6253). This was cut to a predetermined size, obtaining a low-resistance connector. The connector was examined for performance.

Volume resistivity and puncture were examined by the following tests, with the results shown in Table 6.

Volume Resistivity

The connector as completed was compressed 10%. It was rated "OK" when the volume resistivity was lower than $10^{-3}$ Ω-cm and "Rejected" when the volume resistivity was higher than $10^{-3}$ Ω-cm.

Puncture

A laminate block sized 200 mm high and 200 mm square was press vulcanized under a pressure of 100 kg/cm$^2$ for 15 hours and then sliced. The slices were examined. The rating was "OK" when no puncture was found on every slice and "Rejected" when puncture was found on the slice.

TABLE 7

| | | E13 | E14 | E15 | E16 | E17 | CE4 | CE5 |
|---|---|---|---|---|---|---|---|---|
| Components (parts by weight) | Siloxane polymer | 100 | 100 | 100 | 100 | 100 | 100 | 100 |
| | Conductive powder a | 400 | 500 | 600 | — | — | — | — |
| | Conductive powder b | - | — | — | 400 | — | — | — |
| | Conductive powder c | — | — | — | — | 400 | — | — |
| | Conductive powder d | — | — | — | — | — | 400 | — |
| | Conductive powder e | — | — | — | — | — | — | 400 |
| Volume resistivity (× $10^{-4}$ Ω-cm) and rating | | 7 OK | 5 OK | 1 OK | 8 OK | 9 OK | 7 OK | 7 OK |
| Puncture in block | | OK | OK | OK | OK | OK | Rejected | Rejected |

Examples 18–21 and Comparative Example 6

Conductive powders (f to k) were obtained as in Example 13 except that fumed silica having a specific surface area of 200 m$^2$/g (Aerosil 200 by Nippon Aerosil K.K.) or wet silica having a specific surface area of 180 m$^2$/g (Nipsil LP by Nippon Silica K.K.) was used instead of the hydrophobic silica R-972.

TABLE 7

| Conductive powder | f | g | h | j | k |
|---|---|---|---|---|---|
| Silver powder (g) | 99.5 | 99.0 | 97 | 95 | 90 |
| Aerosil 200 (g) | 0.5 | 1.0 | 3.0 | 0 | 10 |
| Nipsil LP (g) | 0 | 0 | 0 | 5 | 0 |

As in Example 13, connectors were prepared using the conductive powders and similar examined. The results are shown in Table 9.

TABLE 8

| | | E18 | E19 | E20 | E21 | CE6 |
|---|---|---|---|---|---|---|
| Components (parts by weight) | Siloxane polymer | 100 | 100 | 100 | 100 | 100 |
| | Conductive powder f | 450 | — | — | — | — |
| | Conductive powder g | — | 450 | — | — | — |
| | Conductive powder h | — | — | 450 | — | — |
| | Conductive powder j | — | — | — | 450 | — |
| | Conductive powder k | — | — | — | — | 450 |
| | Dicumyl peroxide | 0.5 | — | — | — | 0.5 |
| | C-19A | — | — | 1.0 | 1.0 | — |

TABLE 8-continued

| | E18 | E19 | E20 | E21 | CE6 |
|---|---|---|---|---|---|
| C-19B | — | — | 2.5 | 2.5 | — |
| Volume resistivity (× $10^{-4}$ Ω-cm) and rating | 6 OK | 6 OK | 7 OK | 8 OK | 100 OK |
| Puncture in block | OK | OK | OK | OK | Rejected |

The conductive element made of the conductive silicone rubber composition according to the invention has a reduced volume resistivity and a stabilized electrical resistance and thus allows a large amount of current to flow. The low-resistance connector using the conductive element has a minimized variation of resistivity, ensures a stable contact, and allows minor amounts of current to flow. The connector is not only suitable for connection to a color liquid crystal module or plasma display module, but is also used in a fully steady state in circuits requiring high values of current.

When the connector is used in an instrument for the inspection of IC chips, the connector ensures good contact at a low compression rate. This reduces the load applied to the instrument, avoids terminal deformation and internal failure of IC chips, ensures more precise inspection, and contributes to size and weight reductions of such instruments.

The connector of the invention can be manufactured using the existing apparatus. The occurrence of rejects during block manufacture is suppressed, resulting in an increased production yield and a reduced production cost.

Japanese Patent Application Nos. 11-081928 and 11-105095 are incorporated herein by reference.

Reasonable modifications and variations are possible from the foregoing disclosure without departing from either the spirit or scope of the present invention as defined by the claims.

What is claimed is:

1. A conductive silicone rubber composition comprising (A) 100 parts by weight of an organopolysiloxane having at least two aliphatic unsaturated groups, represented by the following average compositional formula (1):

$$R^1{}_nSiO_{(4-n)/2} \quad (1)$$

wherein $R^1$ is independently a substituted or unsubstituted monovalent hydrocarbon group and n is a positive number of 1.98 to 2.02, (B) 100 to 800 parts by weight of a conductive powder comprising a silver powder premixed with at least 0.2% by weight of fine powder selected from the group consisting of inorganic fillers and spherical organic resins, and (C) a sufficient amount of a curing agent to cure component (A).

2. The composition of claim 1 wherein said fine powder of component (B) is silica fine powder.

3. The composition of claim 2 wherein the silica fine powder has a specific surface area of at least 50 $m^2/g$.

4. The composition of claim 1 wherein in the conductive powder, the silver powder is premixed with 0.5 to 5% by weight of the fine powder of component (B).

5. A low-resistance connector comprising a plurality of alternating layers of a conductive elastomer and an insulating elastomer, at least one elastomer being flexible, which are alternately disposed to form a multilayer structure such that their juncture surfaces are parallel to each other, each said conductive elastomer layer comprising as a conductive element a cured product of a silicone rubber composition comprising (A) 100 parts by weight of an organopolysiloxane having at least two aliphatic unsaturated groups, represented by the following average compositional formula (1):

$$R^1_nSiO_{(4-n)/2} \quad (1)$$

wherein $R^1$ is independently a substituted or unsubstituted monovalent hydrocarbon group and n is a positive number of 1.98 to 2.02, (B) 100 to 800 parts by weight of a conductive powder comprising a silver powder premixed with at least 0.2% by weight of fine powder selected from the group consisting of inorganic fillers and spherical organic resins, and (C) a sufficient amount to cure component (A) of a curing agent.

6. The connector of claim 5 wherein said fine powder of component (B) is silica fine powder having a specific surface area of at least 50 $m^2/g$.

7. A method of preparing a conductive silicone rubber composition comprising mixing:

(A) 100 parts by weight of an organopolysiloxane having at least two aliphatic unsaturated groups, represented by the following average compositional formula (1):

$$R^1_nSiO_{(4-n)/2} \quad (1)$$

wherein $R^1$ is independently a substituted or unsubstituted monovalent hydrocarbon group and n is a positive number of 1.98 to 2.02;

(B) 100 to 800 parts by weight of a conductive powder comprising a silver powder and at least 0.2% by weight of a fine powder of an inorganic filler or a spherical organic resin wherein the silver powder is premixed with the fine powder, and thereafter, said conductive powder is mixed with said organopolysiloxane and a curing agent, and (C) a sufficient amount of said curing agent to cure said organopolysiloxane.

8. The method according to claim 7, wherein said fine powder is a silica fine powder.

9. The method of claim 8, wherein the silica fine powder has a specific surface area of at least 50 $m^2/g$.

10. The method of claim 7, wherein said silver powder is premixed with 0.5 to 5% by weight of said fine powder.

11. The method of claim 7, wherein said silver powder is the form of particulates, dendrites or flakes.

12. The method of claim 7, wherein said silver powder has a mean particle size in the range of 0.05 to 100 $\mu$m.

13. The method of claim 7, wherein said conductive powder comprises conductive carbon black, conductive zinc white or conductive titanium oxide, or optionally, an extending filler of silicone rubber powder, red iron oxide, ground quartz or calcium carbonate.

14. The method of claim 7, wherein said inorganic filler is a silica, an alumina, a titanium dioxide, a mica, a barium sulfate, or a carbon black.

15. The method of claim 7, wherein said spherical organic resin is a polyethylene, a polyvinyl chloride, a polypropylene, a polystyrene, a styrene-acrilonitrile copolymer, a polymethylmethacrylate, an amino resin, a fluorinated resin, or a nitrile resin.

16. The method of claim 7, wherein the mean particle size of said inorganic filler and said spherical organic resin is 0.005 to 50 $\mu$m.

17. The method of claim 7, wherein the $R^1$ is, independently, a substituted or an unsubstituted monovalent hydrocarbon group of 1–10 carbon atoms.

18. The method of claim 7, wherein the $R^1$ is, independently, a group of methyl, ethyl, propyl, butyl, hexyl, octyl, cyclohexyl, vinyl, allyl, propenyl, butenyl, hexenyl, phenyl, tolyl, benzyl, or phenylethyl; optionally substituted with at least one halogen atom or a cyano group.

* * * * *